US005992708A

United States Patent [19]

Gaichuk

[11] Patent Number: 5,992,708

[45] **Date of Patent: *Nov. 30, 1999**

[54] ACTUATOR NOZZLE

[76] Inventor: Andrew Gaichuk, 63 Greyabbey Trail, Toronto, Ontario, Canada, M1E 1V8

[ * ] Notice: This patent issued on a continued prosecution application filed under 37 CFR 1.53(d), and is subject to the twenty year patent term provisions of 35 U.S.C. 154(a)(2).

[21] Appl. No.: 09/094,429

[22] Filed: Jun. 8, 1998

Related U.S. Application Data

[63] Continuation-in-part of application No. 08/897,206, Jul. 15, 1997.

[51] Int. Cl.[6] ..... B65D 83/00

[52] U.S. Cl. ..... 222/402.15

[58] Field of Search ..... 222/321.8, 402.13, 222/402.15

[56] References Cited

U.S. PATENT DOCUMENTS

| | | | |
|---|---|---|---|
| 2,941,700 | 6/1960 | Gable | 222/402.15 |
| 3,109,565 | 11/1963 | Kutik | 222/402.15 X |
| 3,159,319 | 12/1964 | Parish | 222/402.13 |
| 3,314,577 | 4/1967 | Doblin | 222/402.15 X |
| 3,318,493 | 5/1967 | Belpedio | 222/402.15 |
| 3,429,484 | 2/1969 | Baldwin | 222/402.13 |
| 3,478,935 | 11/1969 | Brooks | 222/321.8 |
| 3,478,938 | 11/1969 | Krause | 222/402.15 X |
| 3,580,432 | 5/1971 | Brooks | 222/402.13 |
| 3,611,820 | 10/1971 | Hempel | 222/402.13 X |
| 4,328,911 | 5/1982 | Knickerbocker | 222/402.13 X |
| 5,018,647 | 5/1991 | Abplanalf | 222/402.13 X |
| 5,337,927 | 8/1994 | De Laforcade | 222/402.13 X |

FOREIGN PATENT DOCUMENTS

| | | | |
|---|---|---|---|
| 1228142 | 3/1960 | France | 222/402.15 |
| 2413948 | 10/1974 | Germany | 222/402.15 |
| 1359152 | 7/1974 | United Kingdom | 222/402.15 |

*Primary Examiner*—Kenneth Bomberg
*Attorney, Agent, or Firm*—Blake Cassels & Graydon

[57] ABSTRACT

A spray nozzle actuator has a fitment for placement on the ring fitting of a spray can, an hinge or resilient portion, a nozzle pressing portion, and an handle portion extending forwardly of, and along the can. The handle is shaped to avoid obstruction of the spray nozzle, such as by having a large aperture through which a cone of spray may flow with little or no impingement. Using one actuator an operator can hold the spray can in the palm of one hand and reach forward with his or her fingers to grasp the handle. A generally rearward pull on the handle causes the spray can nozzle to move, releasing the spray. In another actuator an operator can reach forward with his or her fingers to grasp the can, and can squeeze the handle toward the can with the palm or a substantial portion of the thumb, using the major muscles of the hand.

19 Claims, 5 Drawing Sheets

ACTUATOR NOZZLE

This is a continuation-in-part of the inventor's U.S. patent application Ser. No. 08/897,206 filed Jul. 15, 1997.

FIELD OF INVENTION

This invention relates generally to actuators for operating a spray dispenser, and in particular to an actuator having a fitment for attachment to a spray container, and a member for operating a spray mechanism.

BACKGROUND OF THE INVENTION

Spray dispenser handles, whether for discharging aerosols from a pressurized container or for operating a pump mechanism to drive a spray out a nozzle, have been known for many years. Typically the container vessel is in the form of a cylindrical can, or largely cylindrical bottle containing the fluid to be dispensed. A nozzle is provided at one end of the cylinder, usually with the opening of the nozzle oriented to spray radially outward relative to the longitudinal axis of the container. Although some sprays are in a continuous straight-line stream, generally the spray leaving the nozzle has a cone shaped zone of coverage. There are three common types of nozzle. The first type is the standard stub nozzle found on gas propellant aerosol containers used in many applications, from automotive touch-up paint to insect repellent. These nozzles are generally actuated by being pressed inwardly along the longitudinal axis of the container. The second type, is also for gas propellant aerosol containers such as those used to dispense expanding foam sealant. This kind of nozzle is supplied with a relatively large, and lengthy angled tube, the nozzle valve being actuated by lateral deflection of the top of the nozzle from the container centreline. The third kind of common nozzle has a reciprocating pump element that is worked by longitudinal pressing.

As pertains to the first and third types of nozzle, existing handles may not be entirely satisfactory. Examples of known spray handles of the inventor Brody are shown in U.S. Pat. Nos. 4,805,812 issued Feb. 21, 1989; 5,086,954 issued Feb. 11, 1992; and 5,323,937 issued Jun. 28, 1994. Also known are U.S. Pat. No. 4,432,474 to Hutchinson et al., issued Feb. 21, 1984 and U.S. Pat. No. 4,401,240 to Brack, issued Aug. 30, 1983. Each of these documents shows an actuating handle for use with a stub nozzle on a standard gas propellant aerosol spray can. The first four of these patents show fittings for removable attachment to the neck ring of the spray can, and, in the fifth instance, a releasable fitting for engaging the body of the can near its upper end. All five have handles which extend rearwardly from the can, that is, in the opposite direction from the spray, and have a moving member akin to a trigger. Motion of the trigger causes the stub nozzle to be depressed, thus allowing a spray of fluid to escape.

In each case the centre of gravity of the can, fluid, and propellant, if any, is well offset from the handle, such that a person wishing to spray a vertical wall, for example, must also apply a bending moment when holding the can to keep it properly oriented. This may place undue stress on the wrist and forearm, and may be uncomfortable. An uncomfortable operator may not spray with the same precision or consistency over time. It would be advantageous to grasp the can relatively close to its centre-of gravity.

Furthermore, in each of the rearwardly depending handle examples noted above, the handle includes a stationary part and a movable trigger part so that the fingers grasp the trigger and the palm of the hand engages the stationary part, the nozzle being operated when the two parts are squeezed together. It would be advantageous to eliminate the stationary part of the handle, and use the can itself as the reacting member.

U.S. Pat. No. 3,987,942 issued Oct. 26, 1976 to Morane et al., shows an handle mechanism for operating an aerosol spray nozzle, that handle extending downwardly along the forward side of the aerosol can such that an operator may grasp the can and handle and squeeze them together. The Morane et al., device appears to have relatively complicated molded parts, and does not spray through or past the handle, but rather ducts the fluid through a long, narrow passageway as shown in FIG. 2 thereof as item 8*b* or in FIG. 9 as item 26. Such a nozzle may not be suitable for use with materials which are likely to clog between uses—such as paints or adhesives for which a shorter nozzle may be desired. Further, while the Morane et al., handle is removable and interchangeable from its own fitting, the can fitting itself does not appear to be intended to be moved from can to can.

U.S. Pat. No. 4,915,263 issued Apr. 10, 1990 to Corba also shows a forwardly depending trigger assembly for a spray nozzle. In this instance the assembly is for operating a pump type nozzle, and the nozzle exit extends forwardly of the handle. The relatively complex parts illustrated do not appear to be suited for use with, or rapid interchange between, standard spray cans.

U.S. Pat. No. 4,077,548 and U.S. Pat. No. 4,077,549 both issued Mar. 7, 1978 to Beard. They show threadably removable pump assemblies mounted to containers. FIGS. 5 and 6 of '548 show a trigger assembly with a push button 59 having a nozzle 60 mounted to the pump assembly. The trigger body portion 61 is bifurcated to straddle the push button. The push button is pulled down using a saddle in the form of a cap 64, fitted tightly on the top of the push button, the cap being connected to the sides of the body portion by links 65 (one on each side). The handles terminate near the neck of the container, rather than well down the body.

An interchangeable actuator with a levered handle would also be advantageous for use with compressed materials such as expandable foam sealants. At present a number of expandable foam sealants are sold in compressed gas containers, the packaging including a threaded spout generally aligned with the longitudinal axis of the can, and a plastic nipple to be mounted on the spout. The nipple typically has an angled arm which feeds an extended discharge tube. An operator positions the outlet of the tube in a location in which foam is desired, and then deflects the spout laterally to cause the foam to be released. The nipple and tube may be supplied either as a monolithic plastic part, or as parts to be assembled.

Use of these foam sealant dispensers may sometimes result in less than optimal distribution. The foam, which can easily coat hands and clothes, is not necessarily given to easy cleaning or removal. As a precaution, at least one manufacturer includes a pair of disposable plastic gloves with its product. It would be advantageous to have a removable handle, interchangeable from can to can, for controlling the dispensing of this foam.

The handles described in co-pending U.S. patent application Ser. No. 08/897,206 filed Jul. 15, 1997 are of benefit to persons who may suffer from arthritis. By keeping the center of gravity of the container within, or near, the grasp of the user's hand, as mentioned above, the wrist may be relieved of some strain. Further, the relatively large handle, and the mechanical advantage of a longer lever, plus the advantage of being able to grasp the handle with several fingers at once and to squeeze the container against the fullness of the palm of the hand, are all advantageous to persons having arthritis, or diminished use of hands, or similar difficulties in operating hand held devices.

In a further development of the invention, a simplified forwardly depending handle can be manufactured efficiently and inexpensively be using a one-piece combined neck fitting clip and hinge, combined with a single piece handle. In another embodiment of the invention the combined neck fitting and hinge can be reversed, such that an opening is formed to permit the spray to flow in an unobstructed manner past the hinge, and a large handle monolithic handle portion depends rearwardly of the container and presents a relatively large bearing area and lever arm against which a relatively large surface of the thumb may act while several fingers grasp the forward portion of the container.

In this latter embodiment, as before, the relatively small operating parts of a gun-like trigger and handle mechanism, as shown, for example, in U.S. Pat. No. 4,432,474 noted above, such as may be difficult for an arthritic person to operate, are eliminated. Similarly there is no stationary part extending rearwardly of the container, and the center of gravity of the container remains within, or close to, the envelope of the hand's grasp. Whether the handle extends downwardly and forwardly of the container, or downwardly and generally rearwardly of the container, the action which releases the propellant is a squeezing action of the major muscles of the hand, with part of the hand working against the container, and another part of the hand working against the lever. This is an attractive feature for persons having frequent pain in their knuckles and joints of the fingers.

U.S. Pat. No. 4,186,855 of Edman et al., issued Feb. 5, 1980 shows a rearward handle for operating a spray pump bottle. The handle is removably securable to the threaded portion of the bottle, and includes a stationary handle (30) also extending rearwardly and downwardly from the neck of the container. It is operated by squeezing the moving lever and the stationary lever together. The center of gravity lies forward of the hand, and it appears that one is not intended to grasp the forward portion of the container with the fingers.

There is, therefore, a need for an improved, relatively simple actuator assembly.

DISCLOSURE OF INVENTION

The present invention relates to a nozzle actuator for use with a container having a nozzle, the actuator being suited to be attached to the container and having an handle hanging down the same side of the container as that to which a spray or stream of material leaves the nozzle, such that a person holding the container in the palm of their hand may grasp the handle with the fingers of the same hand and operate the nozzle while the centre of gravity of the container is held near the centre of the hand.

In a first aspect of the invention, there is an actuator for use with a container for holding contents to be dispensed, the container having a longitudinal axis and a displacement activated nozzle whence the contents can be released in a direction having a radial component relative to the axis, the actuator comprising a fitment for attachment to the container; a nozzle displacing member connected to the fitment; an handle connected to the nozzle displacing member and having an operator engageable portion locatable in spaced relationship from the container in the direction of the radial component; the handle having a passage to permit material emanating from the container to traverse the handle; and the handle movable to cause the nozzle displacing member to displace the nozzle and release the contents.

In a second aspect of that the invention, the actuator is a removably attachable fitment for removable attachment to the container.

In a third aspect of the invention there is an actuator for use with an aerosol spray container having a stub nozzle oriented to spray in radial direction defined as a forward direction, the actuator comprising a removable fitment for attachment to the container; a pressing member connected to the fitment for contacting the stub nozzle; an handle extending from the pressing member; the handle having a gripping portion locatable in spaced relationship adjacent a forward region of the container; and the handle having a shape to permit unobstructed passage of spray emanating from the nozzle.

In yet another aspect of the invention there is an actuator for use with a pressurized container for holding contents to be dispensed, the container having a longitudinal axis and a displacement activated nozzle and nozzle discharge tube whence the contents can be released in a direction having a radial component relative to the axis, the actuator comprising a fitment for attachment to the container; a nozzle displacing member connected to said fitment; an handle connected to the nozzle displacing member and having an operator engageable portion locatable in spaced relationship from the container in the direction of the radial component; the handle having a passage to permit the discharge tube to traverse the handle; and the handle movable to cause the nozzle displacing member to displace the nozzle and release the contents.

DETAILED DESCRIPTION OF THE INVENTION

Figure 2:
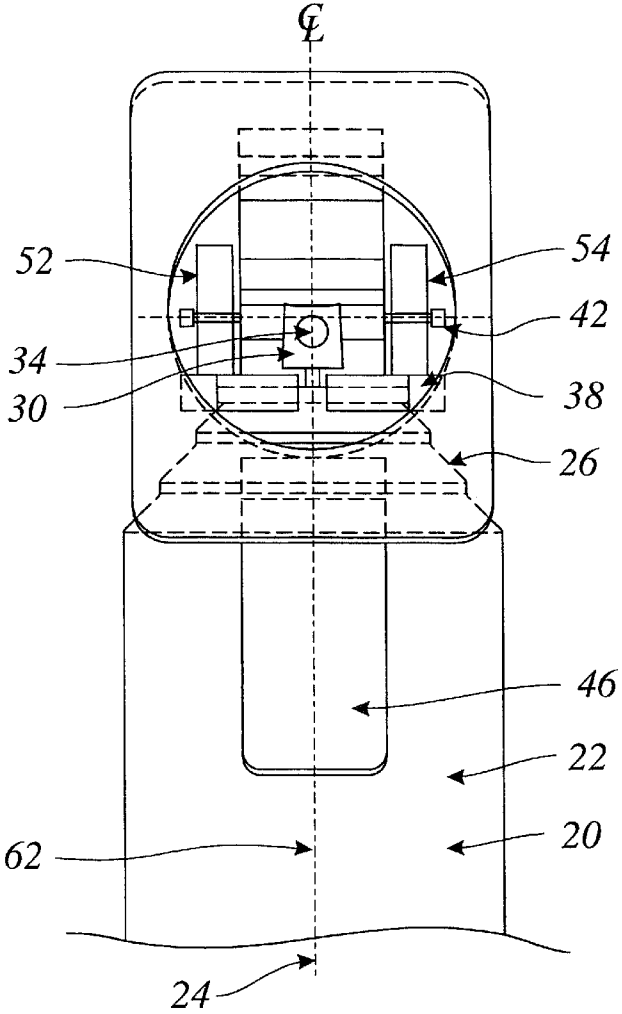
FIG. 2 is a frontal view of the spray actuator of FIG. 1.

In the description which follows, like parts are marked throughout the specification and the drawings with the same respective reference numerals. The drawings are not necessarily to scale and in some instances proportions may have been exaggerated in order more clearly to depict certain features of the invention.

Figure 1:
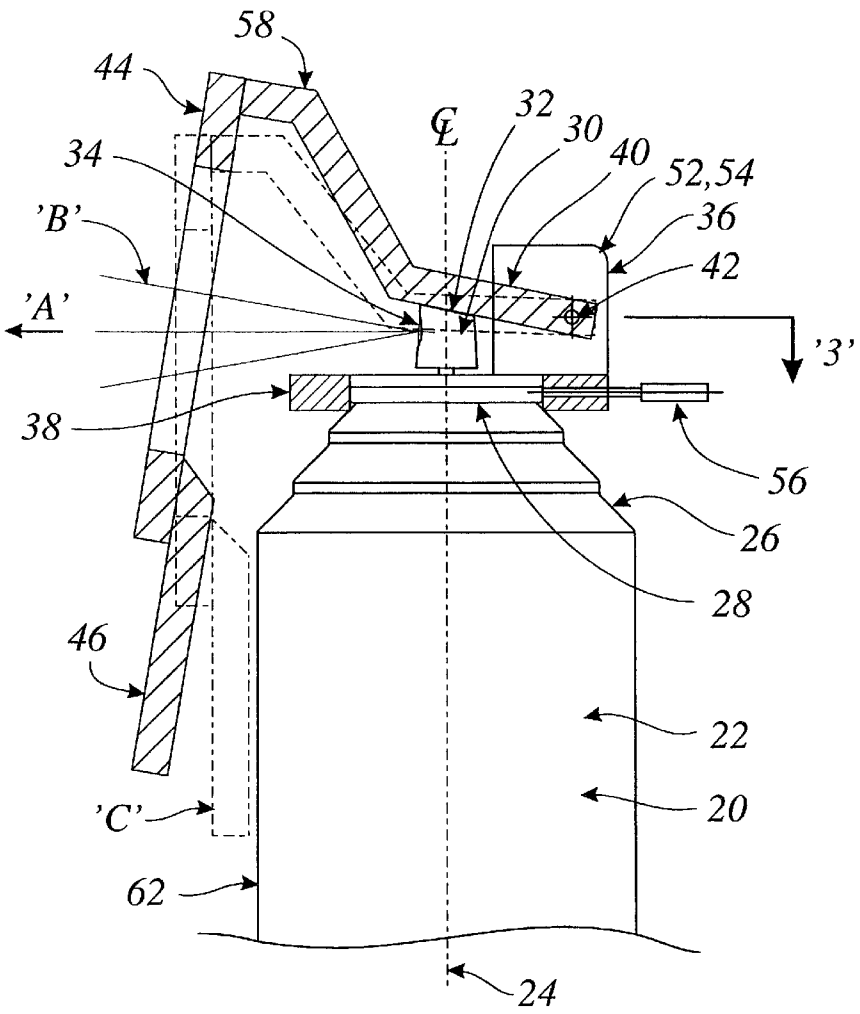
FIG. 1 is a profile, in section, of an embodiment of a spray actuator according to the present invention shown mounted to a spray container.

A standard compressed gas aerosol can is indicated in FIGS. 1 and 2 as 20. It has a cylindrical body 22 having a longitudinal axis 24, and a dispensing end 26 having a standard diameter ring fitting 28 and a centrally located stub nozzle, or push button nozzle 30, having a top surface 32 for pressing, and an aperture 34 whence spray departs can 20 radially, generally in a conical form. For the purposes of this description, the forward direction is the direction in which the spray flows, and is indicated by arrow 'A'.

A first embodiment of an actuator for use with can 20 is indicated generally as 36 in FIGS. 1 and 2. Actuator 36 has a fitment 38 for attaching to ring fitting 28, a push button pressing member 40 pivotally linked to fitment 38 by an hinge pin 42, and an handle 44 connected to, and extending forwardly and downwardly of, pressing member 40, handle 44 itself having a rearwardly recessed hand grip 46.

Figure 3:
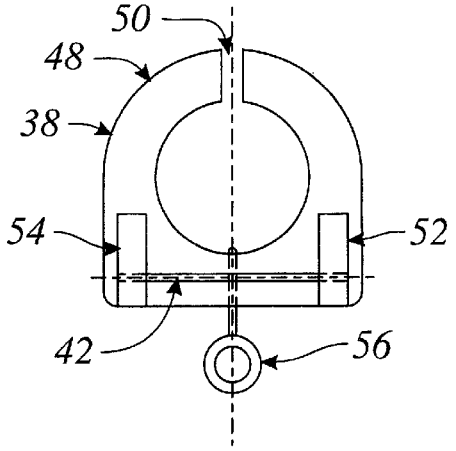
FIG. 3 is a plan view, in detail, of a fitment of the actuator of FIGS. 1 and 2.

As shown in FIG. 3, fitment 38 has a flange in the form of a split ring 48 with a gap 50, for seating about ring fitting 28; and a parallel, spaced apart pair of upstanding legs 52 and 54 which form a clevis for receiving hinge pin 42, about which pin pressing member 40 may pivot. A thumb screw 56 is threaded into, and through, split ring 48 opposite gap 50, by which means split ring 48 may be tightened onto ring fitting 28.

Pressing member 40 has an upward crook 58 for location forward of push button nozzle 30; handle 44 being mounted to, and hanging from, the distal end of crook 58. As seen in FIG. 2, handle 44 has a central, circular aperture 60 of a size sufficient comfortably to avoid the conical zone of spray, indicated as 'B'. Thus it is intended that spray emanating from nozzle 30 may flow unimpeded in the direction of arrow 'A' toward a chosen object, traversing the profile of handle 44 as it does so.

In use, actuator 36 is mated to a standard container by seating split ring 48 about ring fitting 28 as shown, and tightening thumb screw 56. Pressing member 40 is positioned in contact with push button nozzle 30, with handle 44 extending downwardly adjacent and spaced somewhat away from the forward side 62 of the cylindrical body of can 20. Can 20 is held in the palm of the hand, with thumb hooked around the back. The operator's fingers are outstretched to curl around hand grip 46. In such a position the centre of gravity of can 20 and its contents will in general be within the envelope of the hand, or very close to it, such that the effort required to hold can 20 in a chosen orientation may tend to be less than for a can cantilevered out from a trigger-type handle. Squeezing handle 46 either partly or fully rearwardly relative to can 20 toward full open operating position 'C', indicated in dashed lines in FIG. 1, causes the spray to exit can 20.

The length of handle 44, extending a substantial distance along cylindrical body 22 gives it a large mechanical advantage over the relatively short lever arm from the contact of pressing member 40 against push button nozzle 30 to the fulcrum point at hinge pin 42. Furthermore, handle 44 may be grasped by several fingers at once, allowing an operator to bring the musculature of the entire hand to bear, most probably with greater control sensitivity than when pressing a standard nozzle downward with a single thumb or finger, and with a decreased likelihood of the operator's hand, fingers, or thumb coming in contact with, for example, spray or drips of paint, glue or other substances emanating from aperture 34.

Figure 5:
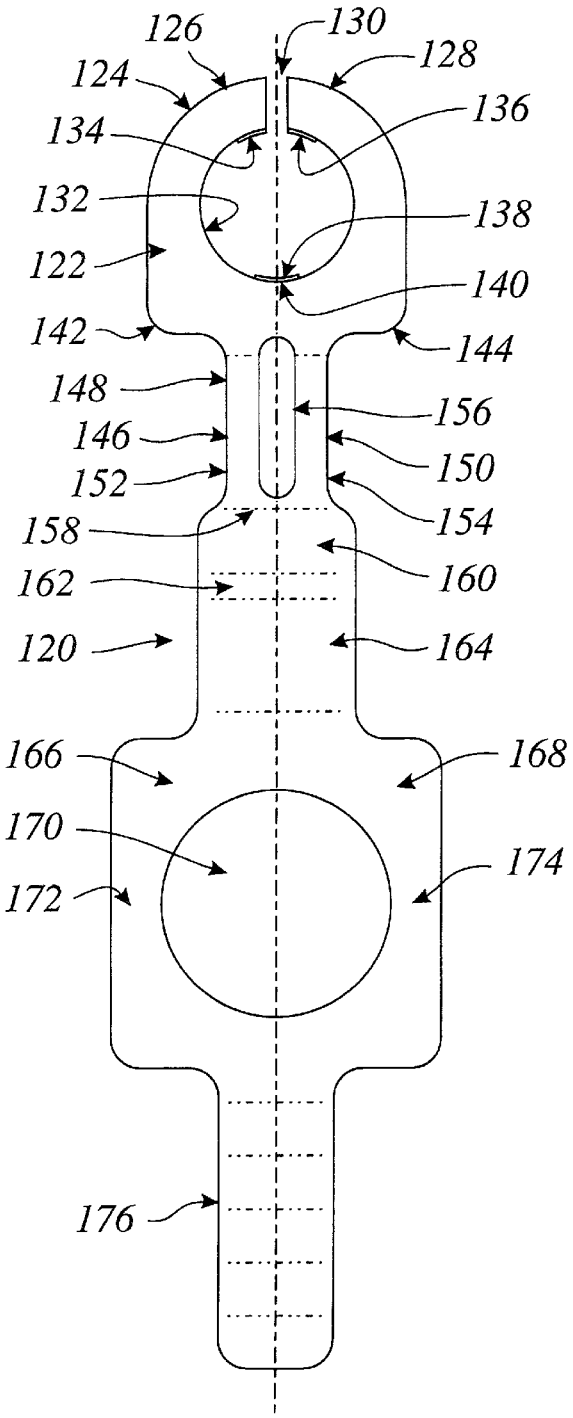
FIG. 5 is developed view of the actuator of FIG. 4.
Figure 4:
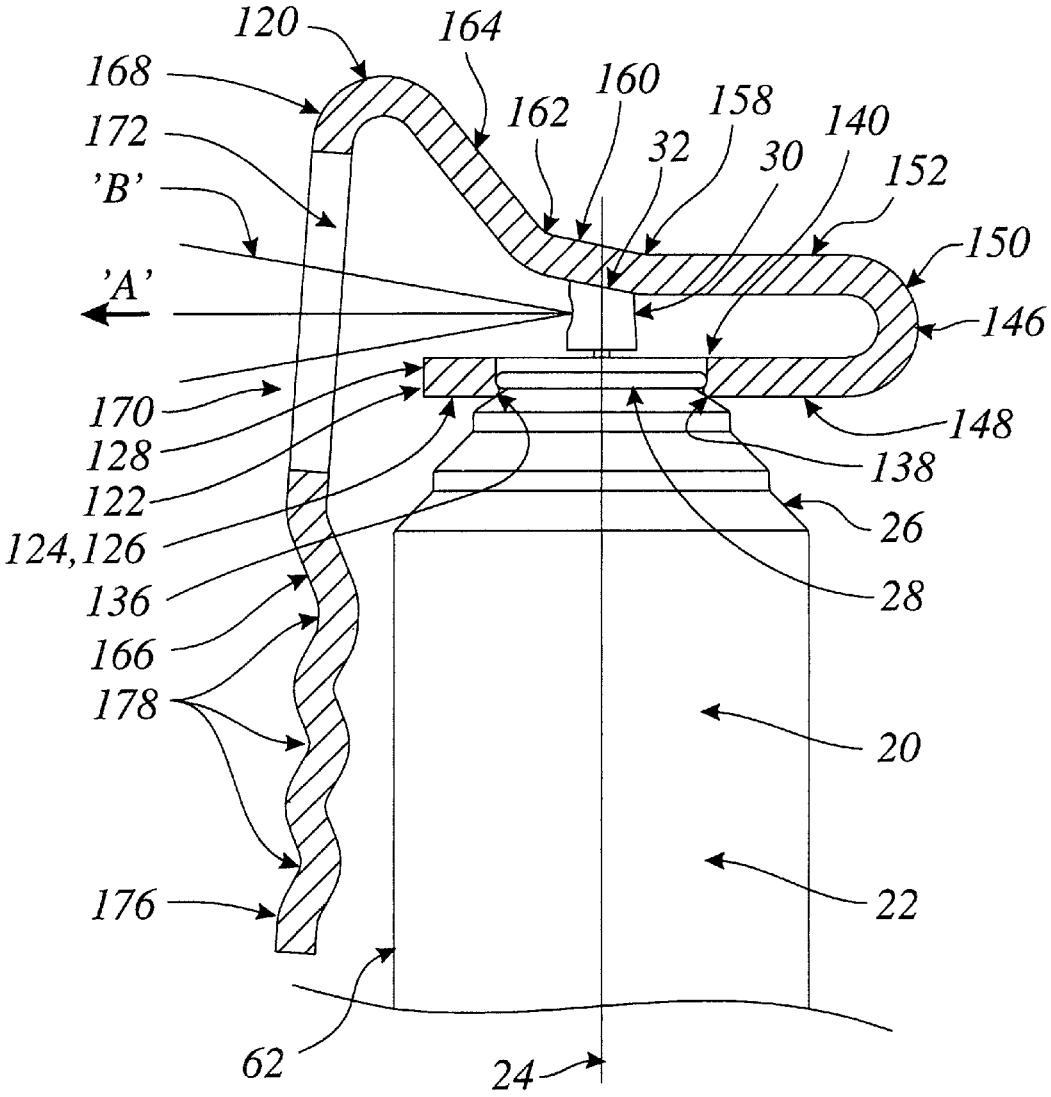
FIG. 4 is a profile view of an alternate embodiment of spray actuator according to the present invention, also shown mounted to a spray container.

An alternative embodiment of a spray actuator is shown in FIGS. 4 and 5. This embodiment shows a single piece actuator generally as 120 made from a material of substantially constant thickness. As before, it has a fitment 122 of a size for seating in an interference fit about ring fitting 28, fitment 122 having a split ring flange 124 terminating in toes 126 and 128 separated by a gap 130. Split ring flange 124 has an inward face 132 of a radius corresponding to the diameter of ring fitting 28, or slightly less, to yield an interference. Three blisters, 134, 136, and 138, extend inwardly of face 132 near toes 126 and 128, and near the crotch 140 of flange 124 respectively, and are intended have a snap fit under ring fitting 28 against dispensing end 26. To that end, removal of fitment 122 from ring fitting 128 is facilitated by the generally squared corners 142 and 144 of flange 124, against which a person holding can 20 may push with their thumbs to urge blister 138 past ring fitting 128, thereby releasing actuator 120 from can 20.

Although inward face 132 extends about substantially the entire circumference of ring fitting 28, leaving only small gap 130 a larger gap could be used, and need not have a contacting substantially annular fitting, like flange 122. Rather, a fitment having a continuous arc, or intermittent contact feet, engaging comfortably more than 180 degrees of arc of ring fitting 28, thereby capturing it, would be sufficient. For example, a fitment having three or four contact feet on 120 or 90 degree centres, respectively could be used.

Fitment 122 further includes a resilient member 146 extending rearwardly from flange 128, having a rearward run portion 148, a continuously curved 180 degree reverse bend 150, and a forward run portion 152. Resilient member 146 acts as a spring, and while resilient is more compliant than adjoining portions of actuator 120 generally.

Forward run portion 152 of resilient member 146 of actuator 120 terminates at an upward crimp 158 giving onto a nozzle pressing member 160, angled forwardly upward at a convenient angle for meeting top surface 32 of nozzle 30. Pressing member 160 is in turn connected at upward bend 162 to a crook 164 whence a handle 166 depends in a generally downward direction.

Handle 166 has an upper plate 168 pierced by a central aperture 170 leaving side webs 172 and 174, aperture 170 again being of suitable size to avoid impingement by spray cone 'B'. Handle 166 further includes a finger grip 176 depending from plate 168, finger grip 176 being provided with a number of undulations 178 to be engaged by the fingers of an operator.

Figure 6:
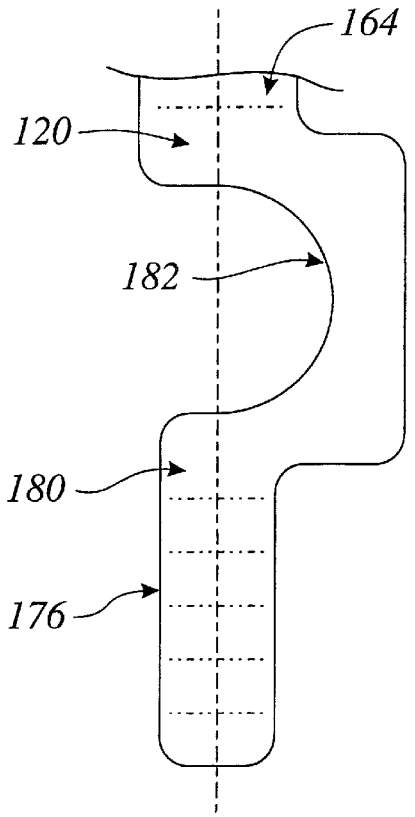
FIG. 6 shows an alternative, asymmetric handle for use with the actuators of either FIG. 1 or FIG. 4.

A further alternative handle is shown in the detail of FIG. 6. An asymmetric handle 180 having a dog-leg 182 to avoid the envelope of conic spray zone 'B' is shown depending from crook 164, and terminating in finger grip 176 as before. Handles of various configurations, whether straight-legged, semi-circular, or arbitrarily curved, could be chosen which extend forwardly of the point of commencement of cone 'B' at nozzle aperture 34, provide in all cases that the handle is shaped to avoid the envelope of conical spray zone 'B', whether by having an aperture with a closed perimeter, such as a circle or oval hole, or an open sided bight such as an U-shaped channel, dog-leg or semi circle, thereby leaving an allowance, or passageway by which spray from behind the handle is able to traverse the profile of the handle in the direction of arrow 'A'. A symmetrical aperture and supporting structure is convenient since it tends to discourage twisting such as might occur with an asymmetric handle.

The function of blisters 134, 136 and 138 could probably be achieved with a continuous counterbore of slightly smaller radius than face 132, a ridge, a ledge, a number of dimples, or lips, or tongues, or teeth, of chosen dimension to give a satisfactory snap and while not being so tight-fitting as to be excessively difficult to remove from ring fitting 28. A standard size of pressurized aerosol can neck ring fitting is about 1.28 inches in outside diameter, and this is the size of fitting intended to be engaged by blisters 134, 136, and 138. The principles of the invention would apply equally to other sizes of neck ring fittings.

The springiness of resilient member 146 can be altered by changing its length, the width or neck 154, the proportions of slot 156, and the local thickness of the material. One need not use both neck 154 and slot 156, but could use one or the other, or both as may be found satisfactory. The use of resilient member 146 permits the elimination of pivoting hinge of the embodiment of FIGS. 1 and 2.

Actuator 120 is shown as having been formed from a flat sheet of uniform thickness, cut and bent to shape. It could be a molded plastic part made, for example, from a polycarbonate plastic. It could also be made of a relatively thinner metal or plastic part incorporating stiffening ribs. It could be made as a sheet metal stamping, and depending on the geometry chosen, with drawn or bent reinforcing flanges.

Figure 7:
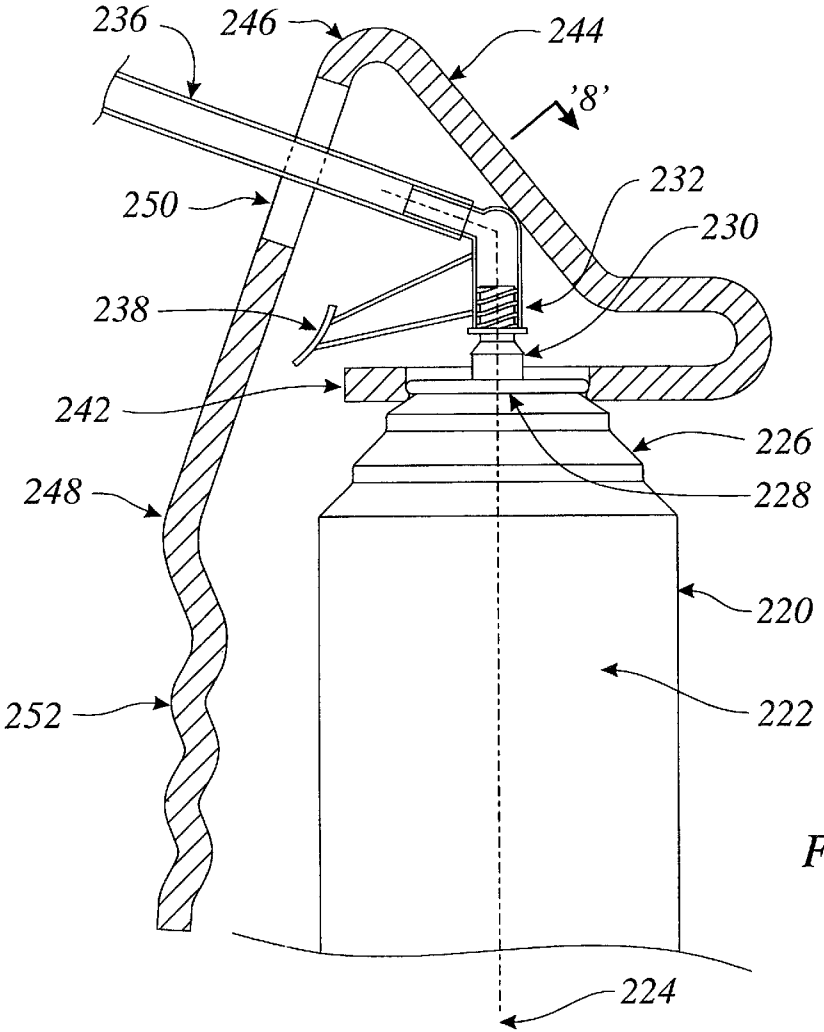
FIG. 7 shows a profile view analogous to FIG. 1, of a second alternate embodiment of actuator according to the present invention as mounted to a standard expandable foam third embodiment container.

In FIG. 7 a compressed gas container, such as might contain expandable foam sealant, is shown as 220, and has a cylindrical body 222 having a longitudinal axis 224, surmounted by a dispensing end cap 226 itself having a stand ring fitting 228 and coaxial a threaded discharge valve spout 230. A matingly threaded, angled spigot 232 is attached to spout 230, and has an angled arm 234 whence an applicator tube 236 extends to some distance, for example 6 to 8 inches. Spigot 232 may also include an integrally molded plastic handle 238. When spigot 232 is bent away from axis 224 the matter under pressure in container 220 is permitted to flow out through tube 236, the rate of flow being a function of the angle of deflection.

Figure 8:
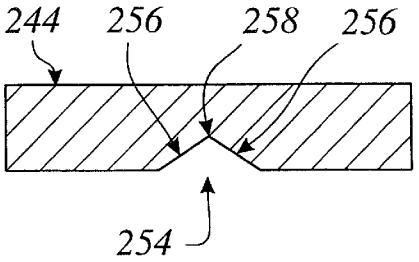
FIG. 8 shows a detail of the actuator of FIG. 7.

An interchangeable actuator is shown generally as 240 and includes a fitment for seating about ring fitting 228 which corresponds in all material respects to items 122 through 158 described above. It differs from actuator 120 in that actuator 240 has a spigot contacting member 242 for deflecting spigot 232 away from axis 224, rather than for pressing a stub nozzle longitudinally towards the body of a can a described above. Contacting member 242 terminates at its foremost end at a curled portion 244 which connects it to an handle 246 having an aperture 248 through which tube 236 can pass; and a handgrip 250, substantially similar to item 166 described above. As seen in the detailed view if FIG. 8, contacting member 242 is preferably provided with a guide channel 252 along which spigot 232 may be engaged, channel 252 acting to discourage wandering.

In use, a rearward pull on hand grip 250 will cause contacting member 242 to push against spigot 232, thus releasing the contents of container 220. Although contacting member 242 is shown as a substantially straight faced part, it acts against spigot 232 in the manner of a cam against a cam follower and could have any chosen cam profile such as may be found satisfactory. Similarly, although a single piece part is shown, a two piece part with hinge could be used. Further, although channel 252 is shown with straight-sided included flanks 254 meeting at an apex 256, a different cross-section, whether flat sided, semi circular, or some other profile, could be used.

Figure 10:
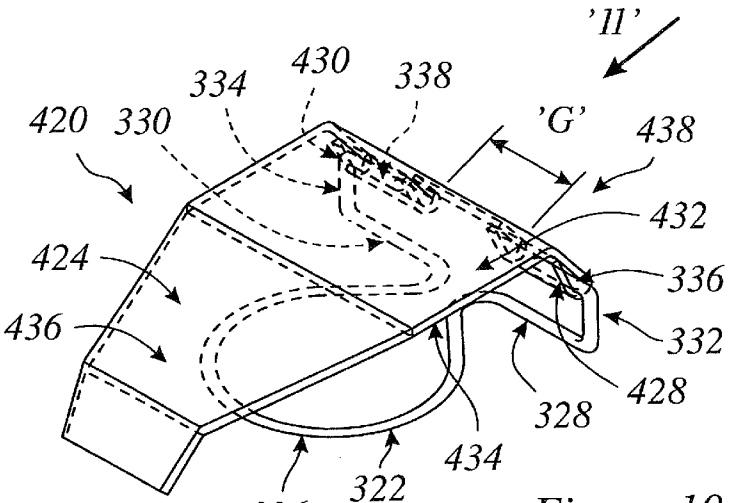
FIG. 10 shows a three quarter view of an alternative embodiment to the handle of FIG. 9, with a rearwardly depending handle.
Figure 11:
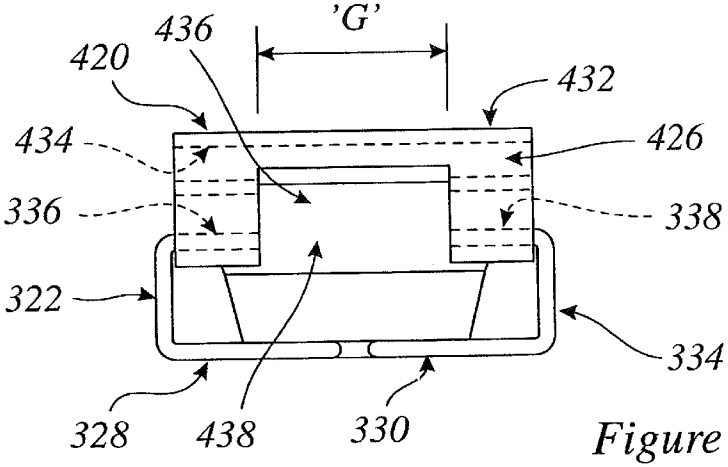
FIG. 11 is a front view of the handle of FIG. 10 taken on arrow '10'.
Figure 9:
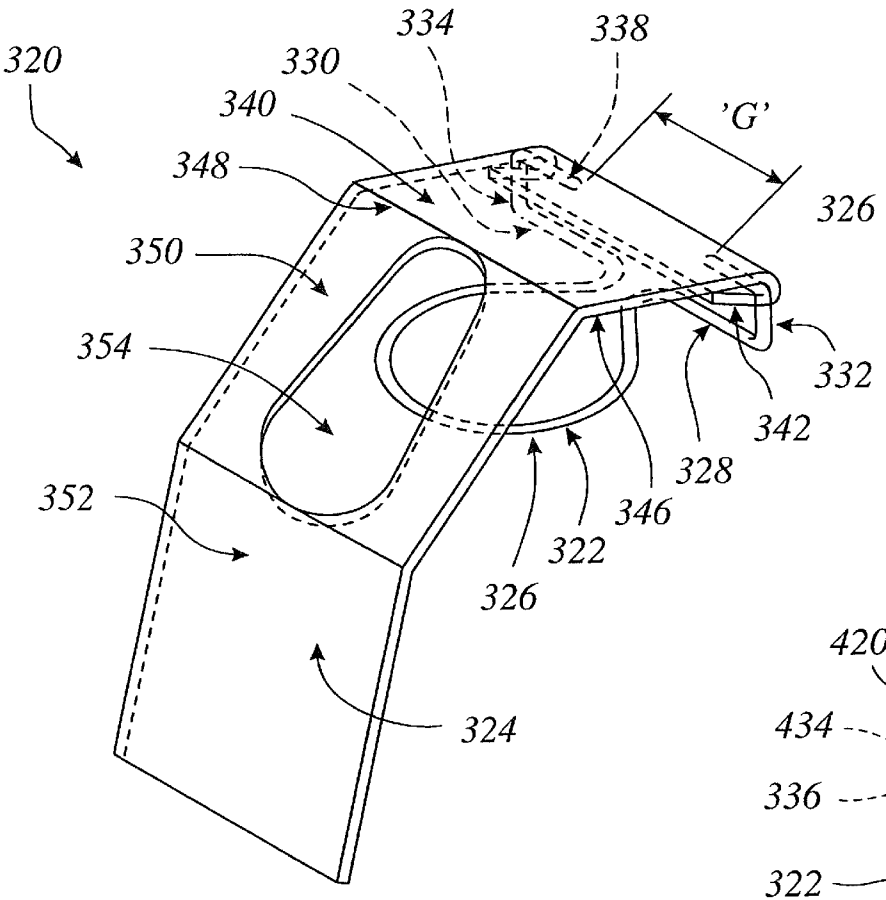
FIG. 9 shows a three quarter view of an alternative embodiment of a forwardly depending handle to that illustrated in FIG. 1.

In the further handles shown in FIGS. 9, 10 and 11, a handle assembly 320 has two parts. The first part is an integral, monolithic spring steel wire neck ring and hinge fitment, 322. The second part is a forwardly depending handle, 324. Fitment 322 has a central bight 326 that is formed nearly into a full loop. The bight is of a size slightly smaller than the size of a standard aerosol can neck ring, such that fitment 322 can be relatively easily, and securely snap fit under the shoulder of such a neck ring, and relatively easily removed therefrom in a manner similar to that previously described. The ends of the bight are curved outwardly, and have outwardly extending legs 328 and 330. Legs 328 and 330 are turned upwardly at their outermost extremities into a pair of upstanding legs 332 and 334. These legs extend upwardly and turn mutually inward at respective knees, the last elements of fitment 322 being a pair of opposed coaxial hinge pins 336 and 338. The ends of these pins are separated by a gap indicated as 'G'. Handle 324 is a monolithic stamped and bent aluminum part. It has a first portion 340 having tangs 342 a folded over lip for wrapping about hinge pins 336 and 338 respectively. First portion 340 has lower face 346 for contacting the stub nozzle of an aerosol can, and terminates at a bend 348 where it gives onto a second portion 350. Second portion 350 extends forwardly from bend 348, and gives in turn onto downwardly depending hand grip portion 352. An aperture 354 having a tear-like shape is let through second portion 350 to permit spray to pass radially, and without obstruction, from an aerosol can forward of hand grip portion 352.

In this embodiment handle 324 need not be made of aluminum, but could be made of plastic, steel, or other reasonably stiff material suitable for use as a lever for deflecting the stub nozzle of an aerosol can. Similarly, as noted above, it could be formed in a dog-leg or bight shape, rather than having an aperture of closed periphery. The aperture need not be tear shaped, but could be round, conical, oval, rectangular, or other shape for permitting a spray to pass. Fitment 322 does not have to be formed in an open-loop shape as shown, but could have a full loop in which the ends of the respective legs form the hinge lines of the opposite sides of the loop, or other suitable shape yielding to an aerosol can neck ring.

In the embodiment of FIGS. 10 and 11, a handle assembly 420 employs the same fitment 322 as employed in the embodiment of FIG. 9, but employs it in a reversed orientation. A single piece, stamped and bent aluminum handle 424 has a first portion 426 having tangs 428 and 430 wrapped about hinge pins 336 and 338 respectively. Hinge pins 336 and 338 share a hinge axis 337, as indicated in FIGS. 10 and 11. A second portion 432 extends rearwardly of first portion 426 and has a lower surface 434 for bearing against, and deflecting, the stub nozzle of a standard aerosol can. A doglegged extension 436 extends rearwardly and downwardly from second portion 432, the dog leg being intended relatively comfortably to accommodate the crease of a user's thumb joint, the better to permit the greater strength of the root portions of the thumb and palm to be applied in opposition to fingers grasping the forward portion of the can. Lastly, first portion 426 has a rebate 438 adjacent gap 'G' between hinge pins 336 and 338. The opening whose periphery is bounded by rebate 438, upstanding legs 332 and 334, and outwardly extending legs 328 and 330 is of adequate size, and in a suitable location for permitting spray emanating radially from an aerosol can stub nozzle to pass unobstructed. The inventor prefers the embodiment of FIGS. 10 and 11 for use with corrosive or aggressive fluids such as oven cleaner or window cleaner.

A preferred embodiment has been described in detail and a number of alternatives have been considered. As changes in or additions to the above described embodiments may be made without departing from the nature, spirit or scope of the invention, the invention is not to be limited by or to those details, but only by the appended claims or their equivalents.

I claim:

1. An actuator for use with an aerosol can having a longitudinal axis and a displacement activated nozzle located at one end of the aerosol can defined as the upward end, whence the contents can be released as a spray in a direction having a radial component relative to the axis, the direction of the radial component defining a forward direction, the aerosol can having a neck ring, said actuator comprising:

a removable fitment capable of snap fit attachment to the neck ring of the aerosol can, said fitment having a hinge; the hinge having a hinge axis locatable upwardly of the neck ring and forwardly of the nozzle, said hinge having a pair of hinge pins separated by a gap and sharing a common axis;

a nozzle displacing member pivotally connected to said hinge and extending upwardly and rearwardly from said hinge;

a handle connected to said nozzle displacing member and having an operator engageable portion extending downwardly and rearwardly from said nozzle displacing member for pressing against an operator's hand in opposition to a force applied to the can by the operator's fingers, said operator engageable portion being locatable in spaced relationship from the container in the direction of a rearwardly radial component;

said actuator having a shape to permit unobstructed passage of spray emanating from the nozzle through the gap between the hinge pins; and said handle being movable to cause said nozzle displacing member to displace the nozzle and release the contents of the can.

2. The actuator of claim 1 wherein said actuator has a spray accommodating passage defined therein and said passage is chosen from the set of (a) an aperture; and (b) a bight.

3. The actuator of claim 1 wherein said nozzle displacing member and said handle are made from a single piece of material, and said handle extends rearwardly and downwardly of said nozzle displacing member to the level of said fitting for engaging the neck ring, at a location rearwardly of said fitting.

4. The actuator of claim 1 wherein said nozzle displacing member is a nozzle pressing member for pressing the nozzle along the axis and said handle has a dog-leg bend and is joined to said nozzle pressing member at a bend located rearwardly of the axis.

5. An actuator for use with an aerosol spray container having an upward end, a neck ring located at the upward end, and a stub nozzle located to extend upwardly of the neck ring and being oriented to spray in a radial direction defined as a forward direction, said actuator comprising:

a removable threadless fitment capable of snap fit attachment to the neck ring of the container, said fitment having a hinge locatable upwardly of the neck ring and forwardly of the nozzle;

a pressing member for contacting the stub nozzle, connected to said hinge;

a handle extending from said pressing member;

said handle having a gripping portion locatable in spaced relationship adjacent a rearward region of the container, said handle being moveable relative to the container to actuate said stub nozzle when the container is grasped by an operator's fingers, the gripping portion is engaged by the hand and said handle is squeezed toward the container by the fingers of the operator;

said handle having a proximal region joined to said pressing member, and a distal region having a tip distant from said pressing member, said handle having a bend formed therein between said nozzle displacing member and said tip, said handle extending rearwardly and downwardly relative to said pressing member; and said distal region being bent rearwardly and downwardly relative to said proximal region to present a continuous engagement surface for engagement by an operator's hand;

said fitment being free of upwardly protruding obstructions to pivotal motion of said operator engageable portion about said hinge; and said handle having a shape to permit unobstructed passage of spray emanating from said nozzle.

6. The actuator of claim 5 wherein said fitment is a removably attachable fitment for removable attachment to the container and is formed of a continuously bent wire, said wire being free of branches.

7. The actuator of claim 5 wherein said actuator has one of:

a) an aperture; and b) a bight, defined therein to permit unobstructed passage of the spray.

8. The actuator of claim 5 wherein said pressing member and said handle are made from a single piece of material.

9. The actuator of claim 8 wherein said material is of substantially constant thickness.

10. An actuator for use with a pressurized container for holding contents to be dispensed, the container having a longitudinal axis, an upward end, a neck ring located at the upward end, and a displacement activated nozzle whence the contents can be released in a direction having a forward radial component relative to the axis, said actuator comprising:

a threadless fitment for attachment to the neck ring said fitment being formed of a continuous bent wire having bent ends to define a hinge locatable upwardly of the neck ring and forwardly of the nozzle;

a nozzle displacing member pivotally connected to said hinge, and extending upwardly and rearwardly therefrom;

a handle connected to said nozzle displacing member and having an operator engageable portion locatable in spaced relationship from the container in a rearward direction relative to the forward radial component, in use said handle being positionable in a position in which said operator engageable portion extends downwardly and rearwardly from said nozzle to a location rearward of said fitment at the level of the neck ring;

said actuator having a passage to permit contents discharged from the nozzle to traverse the handle; and said handle being moveable to cause said nozzle displacing member to displace the nozzle and release the contents.

11. The actuator of claim 10 wherein said fitment is a snap fit removably attachable fitment for removable attachment to the container, and is free of upwardly protruding obstructions to operation of said handle.

12. The actuator of claim 10 wherein said passage is chosen from the set of:

a) an aperture; and b) a bight, for accommodating discharge from the nozzle.

13. The actuator of claim 10 wherein said nozzle displacing member and said handle are made from a single piece of material, said handle adjoins said nozzle displacing member at one bend, and has a dog-legged bend for conforming to the shape of a user's thumb.

14. An actuator for use with a container for holding contents to be dispensed, the container having a longitudinal axis, a displacement activated nozzle whence the contents can be released in a direction having a radial component relative to the axis, and a threadless neck ring, the direction of the radial component defining a forwardly radial direction, said actuator comprising:

a fitment for attachment to the container, said fitment being a bent wire having a portion for engaging the neck ring and end portions bent upwardly and forwardly of said neck ring engaging portion to define hinge pins sharing a common hinge axis, said pins having a gap defined therebetween;

a nozzle displacing member pivotally mounted to said hinge pins;

a handle connected to said nozzle displacing member and having an operator engageable portion for pressing against an operator's hand in opposition to a force applied to the container by the operator's fingers, said operator engageable portion being locatable in spaced relationship from the container in the direction of a rearwardly radial component;

said nozzle displacing member having a passage defined therethrough to permit material emanating from the container to traverse nozzle displacing member;

said handle being movable to cause said nozzle displacing member to displace the nozzle and release the contents of the can.

15. The actuator of claim 14 wherein said handle and said nozzle displacing member are made from a single piece of material, said handle is joined to said nozzle displacing member at a bend, and said handle has a downward and rearward dog leg bend.

16. The actuator of claim 14 wherein said nozzle displacing member extends upwardly and rearwardly of said hinge axis when said actuator is mounted to the container.

17. The actuator of claim 14 wherein said nozzle displacing member has a first portion extending upwardly and rearwardly from said hinge pins, and a second portion extending rearwardly of said first portion, said second portion having a surface for contacting the nozzle, and said passage is defined in said first portion to permit material emanating from the container to traverse said first portion.

18. The actuator of claim 17 wherein said first portion has a pair of tangs mounted to said pair of hinge pins, and said passage includes a rebate defined between said tangs.

19. The actuator of claim 14 wherein said fitment is removably attachable to the container.

* * * * *